United States Patent [19]

Macaire et al.

[11] 4,309,581

[45] Jan. 5, 1982

[54] GAS CIRCUIT BREAKER HAVING INDEPENDENT MAIN AND ARCING CIRCUITS

[75] Inventors: Marcel Macaire, Saint-Egreve; Jean-Louis Mircovich, Seyssins, both of France

[73] Assignee: Merlin Gerin, Grenoble, France

[21] Appl. No.: 87,394

[22] Filed: Oct. 22, 1979

[30] Foreign Application Priority Data

Nov. 14, 1978 [FR] France ..... 78 32214

[51] Int. Cl.[3] ..... H01H 33/70

[52] U.S. Cl. ..... 200/148 R; 200/148 A; 200/146 R

[58] Field of Search ..... 200/148 A, 144 B, 150 G, 200/147 R, 146 R

[56] References Cited

U.S. PATENT DOCUMENTS

| | | | |
|---|---|---|---|
| 3,257,532 | 6/1966 | Lerch | 200/148 A |
| 3,271,548 | 9/1966 | Kesselring | 200/148 B |
| 3,671,696 | 6/1972 | Brunner | 200/144 B |

FOREIGN PATENT DOCUMENTS

| | | | |
|---|---|---|---|
| 488803 | 1/1930 | Fed. Rep. of Germany | 200/150 R |
| 1458334 | 8/1965 | France | 200/147 R |
| 1126362 | 9/1968 | United Kingdom | 200/144 B |

*Primary Examiner*—Robert S. Macon

*Attorney, Agent, or Firm*—Stevens, Davis, Miller & Mosher

[57] ABSTRACT

A puffer-type gas-blast circuit-breaker comprises an interrupting unit mounted in a housing filled with an insulating gas of high dielectric strength such as sulfur hexafluoride. The interrupting unit includes a main circuit having a pair of stationary and movable main contacts, and an arcing circuit having a pair of stationary and movable arcing contacts. An operating mechanism comprises a control rod coupled to the movable contacts so as to open the main contacts before the separation of the arcing contacts. A pair of input and output terminals extend out of the housing, and a shunt conductor is arranged in the arcing circuit between operating rod and the lower terminal. The longitudinally extending main and arcing circuits are connected in parallel to the terminals and form two independent current paths which are cross-wise spaced inside the housing. A partition wall divides the inner space of the housing into two superposed compartments, one of them including the main contacts, and the other the arcing zone.

8 Claims, 2 Drawing Figures

GAS CIRCUIT BREAKER HAVING INDEPENDENT MAIN AND ARCING CIRCUITS

The invention relates to a circuit breaker with an arc-extinguishing device mounted in a housing filled with an insulating gas of high dielectric strength such as sulfur hexafluoride, and including:

a main circuit having stationary and movable main contacts, an arcing circuit comprising stationary and movable arcing contacts forming an auxiliary circuit bypassing said main circuit, an operating mechanism coupled to said movable contacts so as to open said main contacts before the separation of said arcing contacts, said main and arcing contacts being surrounded by said same insulating gas, a pair of input and output terminals extending through the wall of said housing.

The main contacts of a usual circuit breaker surround coaxially the arcing contacts. A slidable member carries the movable main and arcing contacts which are electrically connected to one terminal by a sliding contact. The mass of the movable structure is very important and the main current flows always through the sliding contact. The operating mechanism requires a high operating force and the electrical circuit needs important sections for the current flow. Another disadvantage of the aforesaid prior construction is that an interaction between the main and arcing breakings is possible.

An object of the present invention is to construct a gas circuit-breaker in such a way that the mass of the movable structure is low.

Another object is to provide a circuit-breaker in which a small fraction of main current flows through the relative movement connecting member.

Still another object is to avoid any arc retriking between the main contacts.

In accordance with the present invention, there is provided a gas circuit-breaker in which said main and arcing circuits are connected in parallel to the input and output terminals so as to form two independent current paths inside said housing. Most of the current flows through the main circuit in the closed position of circuit-breaker, and the current is transferred to the arcing circuit at the separation of the main contacts. The arcing circuit comprises a relative movement connecting member arranged between the movable arcing contact and the corresponding terminal so that the value of main current in said member is very low. The main circuit extends along the shortest path arranged between the terminals inside the housing, and is cross-wise spaced from the longitudinally extending arcing circuit. The opening stroke of the pivoting main contact is independent of that of the arcing contacts.

For a better understanding of the invention, reference may be had to the accompanying drawings, wherein.

Figure 1:
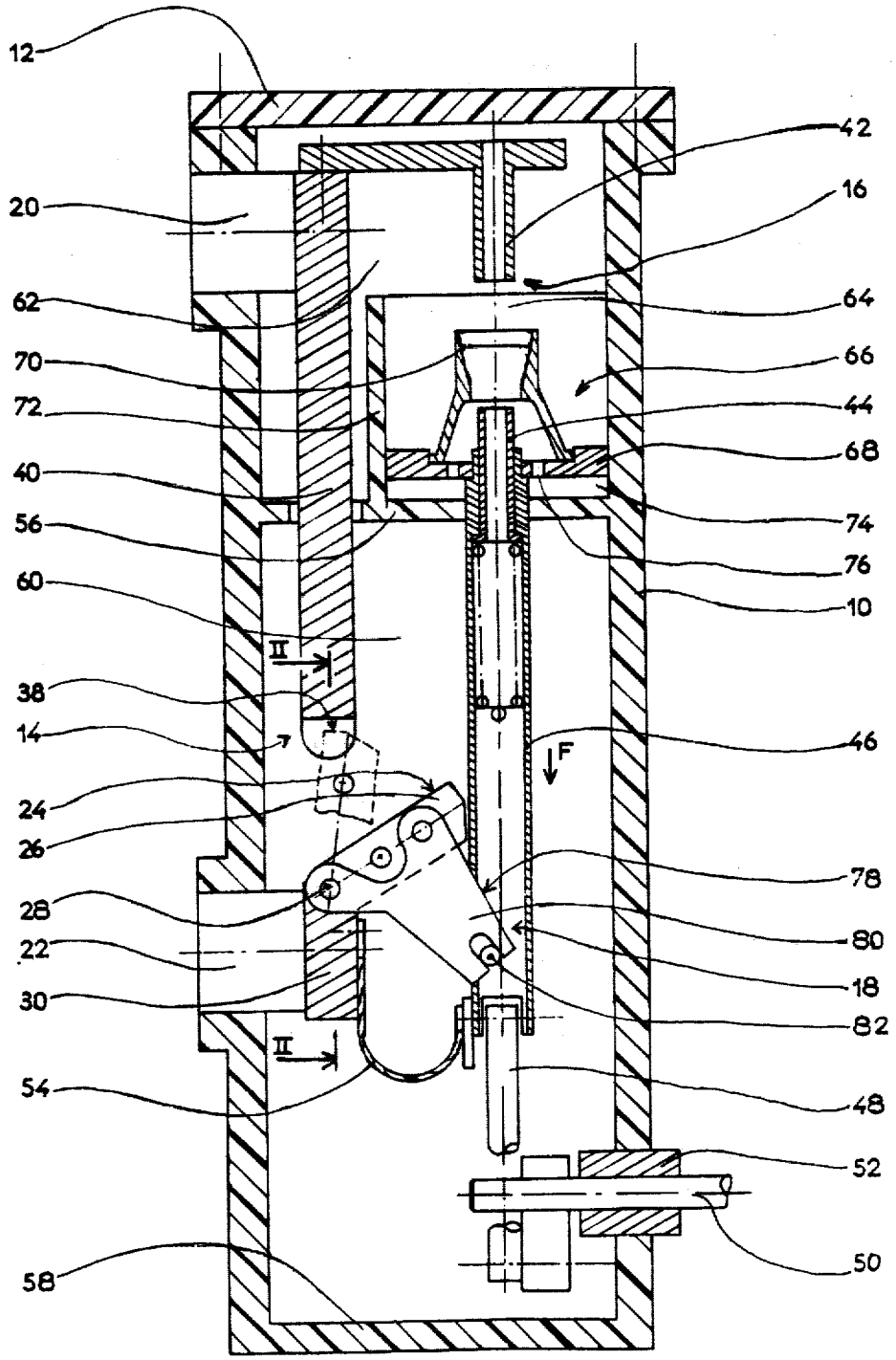
FIG. 1 is a vertical sectional view of a puffer type gas-blast circuit breaker having improved main contact means.
Figure 2:
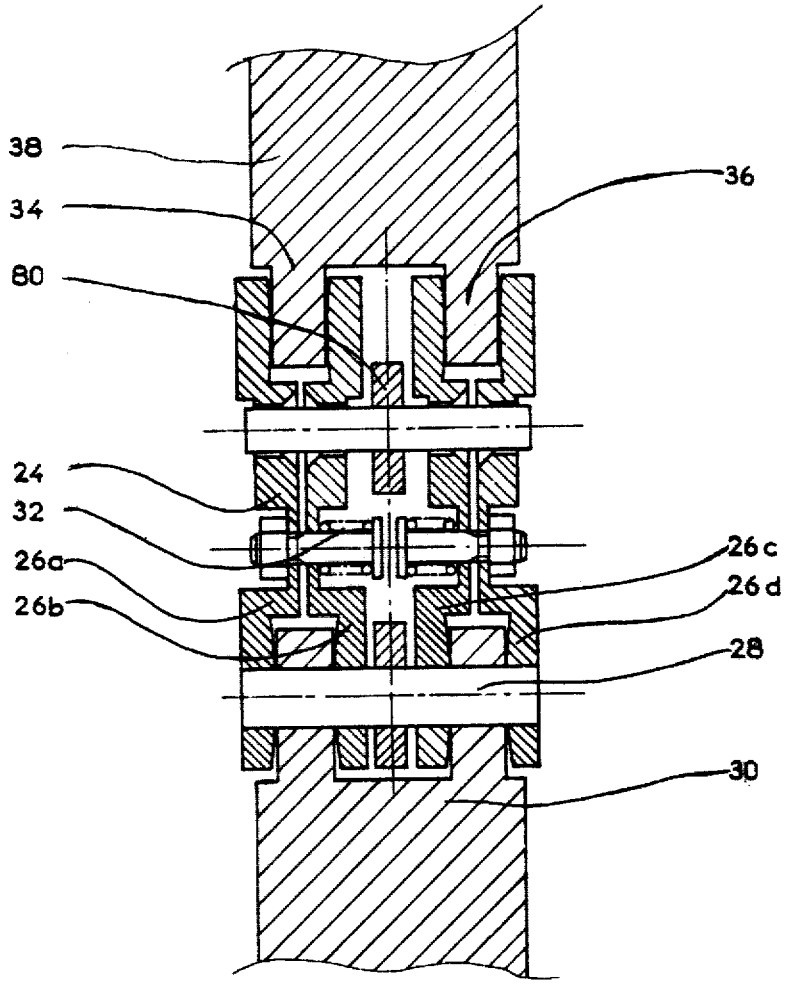
FIG. 2 is a partial sectional view taken along line II—II of FIG. 1, and shown in closed position of the main contacts.

Referring now to FIGS. 1 and 2, there is shown a pole of a puffer-type gas-blast circuit breaker located within a housing 10 filled with an insulating gas of high dielectric strength such as sulfur hexafluoride. A top cover 12 closes the housing 10 of molded insulating material which includes a main circuit 14 through which flows the main current, and an auxiliary arcing circuit 16 which shunts the main circuit. Circuit-breaker opening is effected by an operating mechanism 18 which actuates the movable structure for the successive opening of the main and arcing circuits 14, 16. Two terminals 20, 22 for the current supply are formed by longitudinally spaced bushings extending out of the housing 10.

Main circuit 14 comprises a movable main contact 24 having a plurality of pairs of conductive fingers 26*a*, 26*b*, 26*c*, 26*d*, pivotally mounted upon a stationary pin 28 secured to a first conductor 30 connected to the lower terminal 22. Elastic means, such as a compression spring 32 is associated to each pair for biasing the corresponding fingers against each other so as to form a clamp cooperating in the closed position of main circuit 14 with an extension 34, 36 of a stationary main contact 38. A second conductor 40 connects the stationary main contact 38 to the upper terminal 20. The electrodynamic attraction developed between the fingers of each pair, reinforces the clamping of fingers 26*a*, 26*b*; 26*c*, 26*d* upon the corresponding extension 34, 36.

The auxiliary circuit 16 is connected in parallel to the main circuit 14 inside the housing 10, and includes a pair of aligned arcing contacts 42, 44. The stationary arcing contact 42 is electrically connected to the upper terminal 20, and the movable arcing contact 44 is actuated by a vertically extending conductive rod 46 suitably coupled to a driving crank 48. The external operating mechanism drives the crank 48 by means of a rotative transmission shaft 50 located in a tight bearing 52 arranged in the wall of housing 10. A flexible shunt conductor 54 of the arcing circuit 16 connects electrically conductive rod 46 to the lower terminal 22.

A longitudinally extending inner partition wall 56 divides the inner space of the housing 10 into two superposed compartments 60, 62. The lower compartment 60 includes the main contacts 24, 38, and the upper compartment 62 comprises the arcing zone 64 arranged between the separated arcing contacts 42, 44. The physical separation between arcing zone 64 and the interrupting zone of the main contacts avoids any arc restriking near said interrupting zone due to hot arcing gases.

Terminals 20, 22 form two shunting knots of the two parallel connected main and arcing circuits 14, 16, and the fault current flows exclusively in the shunt conductor 54. The two parallel extending main and arcing circuits 14, 16 are cross-wise spaced inside the housing 10 so as to form a loop of low reactance in which main circuit 14 has the shortest length.

The gas-blast puffer device of a conventional design is lodged in the upper compartment 62 and comprises a movable piston 68 mechanically coupled to driving rod 46. Piston 68 carries a blast nozzle 70 that closely surrounds arcing contacts 42, 44 in the closed position, and is slidably mounted within a stationary cylinder 72 so as to define a puffer chamber 74 in which occurs compression of the insulating gas when contact rod 46 is driven downwardly during the circuit-interrupting operation. An electric arc is then drawn between the separated arcing contacts 42, 44 and a blast of compressed gas flows upwardly through apertures 76 of piston 68 in the nozzle 70 to produce an arc-extinguishing effect.

The operating mechanism comprises a transmission linkage 78 which mechanically connects rod 46 of arcing contact 44 to the movable main contact 24 so as to convert the rectilinear movement of rod 46 into a pivoting movement of contact 24 during circuit interrupting operation. One end of transmission linkage 78 is actuated by a driving pin 82 secured upon rod 46, and the opposite end cooperates with fingers 26 of the movable main contact 24.

In the closed position of circuit breaker, most of the main current flows in the main circuit 14 which has a substantially lower electrical impedance than that of arcing circuit 16. The current flows from upper terminal 20 through conductor 40, stationary main contact 38, movable main contact 24 (shown in dotted lines in FIG. 1), conductor 30 and lower terminal 22. Current through shunt conductor 54 is very low.

At the appearing of a fault current, circuit breaker opening is effected by a downward translation of operating rod 46, indicated by arrow F. During the initial stroke of opening operation, transmission linkage 78 rotates clockwise thus interrupting current flow through main contacts 38, 24. All the current that had been flowing via main circuit 14 is then transferred to the derived arcing circuit 16. Current flows now from upper terminal 20 through stationary arcing contact 42, movable arcing contact 44, conductive rod 46, shunt conductor 54, conductor 30 and lower terminal 22. Upon further movement of rod 46 occurs separation of arcing contacts 42, 44 and a blast of pressurized arc-extinguishing gas flowing from puffer chamber 74 upwardly into the arcing zone to extinguish the arc. Partition wall 56 separates arcing zone 64 from main contacts 38, 24 and prevents any arc restriking between said main contacts.

When the circuit breaker is closed, arcing contacts 42, 44 may be closed in first or after closing of main contacts 24, 38.

The invention has been described in reference to a puffer-type gas-blast circuit breaker, but it is also appropriate to other circuit-breakers having magnetic arc-extinguishing devices or combined magnetic and gas-blast arc-extinguishing devices.

It should be noted that the invention is not restricted to the form of construction shown and many variations in detail may be made; the movable main contact 24 may be a bridging conductive member radially actuated in translation by the operating mechanism during axial movement of rod 46.

What is claimed is:

1. Circuit-breaker with an arc-extinguishing device mounted in a tubular housing filled with an insulating gas of high dielectric strength such as sulfur hexafluoride and including:

a main circuit having stationary and movable main contacts, an independent arcing circuit comprising stationary and movable arcing contacts forming an auxiliary circuit bypassing said main circuit, said movable arcing contact being axially movable in said housing and independent from said main movable contact, an operating mechanism coupled to said movable contacts so as to open said main contacts before the separation of said arcing contacts, said main and arcing contacts being surrounded by said insulating gas, a pair of input and output terminals extending through the wall of said housing and being longitudinally spaced in said housing, said main and arcing circuits being electrically connected in parallel to said input and output terminals and forming two independent current paths inside said housing, said main circuit extending rectilinear along the axial direction of said housing between said input and output terminals inside said housing, and said arcing circuit being laterally spaced from said main circuit, so that the electrical paths comprising loops formed by the main and arcing circuits have substantially the same reactance, said arcing circuit being formed such that a majority of the current of said breaker flows through the main circuit in the closed position of the circuit breaker until the separation of the main contacts, said arcing circuit including a connecting member which can move relative to said arcing circuits arranged between the movable arcing contact and one of a pair of current-supplying terminals so that the magnitude of current in said member as compared to the magnitude of current in said main circuit is low.

2. Circuit-breaker according to claim 1, wherein an interrupting zone of said main contacts inside the housing is spaced from an arcing zone arranged between said arcing contacts so as to avoid an interaction between the main contacts and arcing contacts during current breakings.

3. Circuit-breaker according to claim 2, wherein an inner partition wall is arranged between said zones.

4. Circuit-breaker according to claim 2, wherein a mechanical transmission linkage is coupled to the movable contacts so as to separate said main contacts before separating the arcing contacts, the opening stroke of the main contacts being smaller than that of the arcing contacts.

5. Circuit-breaker according to claim 4, wherein said main contacts comprise a pivoting movable main contact which comes in alignment with the main circuit in a closed position of the circuit breaker, the pivoting movement of said main contact being derived from the rectilinear movement of an actuating rod secured to the movable arcing contact.

6. Circuit-breaker according to claim 1, wherein a puffer type gas-blast means for producing an arc extinguishing gas is associated with said arcing contacts and is actuated by the movement of the movable arcing contact.

7. Circuit-breaker according to claim 1, wherein magnetic means produces a magnetic arc-extinguishing field near said arcing contacts.

8. Circuit-breaker according to claim 1, wherein combined magnetic and gas-blast arc-extinguishing devices are arranged near said arcing contacts.

* * * * *